US007185782B2

(12) United States Patent
Vilchez, Jr. et al.

(10) Patent No.: US 7,185,782 B2
(45) Date of Patent: Mar. 6, 2007

(54) DRINKING DEVICE

(76) Inventors: Brigido L. Vilchez, Jr., 912 Colrain St. SW., Wyoming, MI (US) 49509; Steven R. Turner, 640 Lincoln Ave. NW., Grand Rapids, MI (US) 49504

( * ) Notice: Subject to any disclaimer, the term of this patent is extended or adjusted under 35 U.S.C. 154(b) by 0 days.

(21) Appl. No.: 10/986,243

(22) Filed: Nov. 11, 2004

(65) Prior Publication Data

US 2005/0274722 A1 Dec. 15, 2005

Related U.S. Application Data

(63) Continuation-in-part of application No. 10/866,891, filed on Jun. 14, 2004, now abandoned.

(51) Int. Cl.

| | |
|---|---|
| ***A47G 19/22*** | (2006.01) |
| ***B65D 1/20*** | (2006.01) |
| ***B65D 25/04*** | (2006.01) |
| ***B65D 25/28*** | (2006.01) |
| *B65D 85/72* | (2006.01) |

(52) U.S. Cl. ..... 220/506; 220/501; 220/503; 220/528; 220/636; 220/710; 220/710.5

(58) Field of Classification Search ..... 220/501, 220/506, 703, 705, 710, 710.5, 503, 528, 220/636

See application file for complete search history.

(56) References Cited

U.S. PATENT DOCUMENTS

| | | | | |
|---|---|---|---|---|
| 162,640 | A | | 4/1875 | Fowler |
| 231,747 | A | | 9/1880 | Arnold |
| 1,315,724 | A | | 9/1919 | Hipwell |
| 2,052,344 | A | | 8/1936 | Edelmann |
| 2,355,010 | A | * | 8/1944 | Pera ..... 220/710 |
| 4,191,302 | A | | 3/1980 | Fiducia |
| 4,410,085 | A | * | 10/1983 | Beneziat et al. ..... 206/217 |
| 4,428,490 | A | | 1/1984 | Holloway |
| 4,650,100 | A | | 3/1987 | Echazabal, Jr. |
| 5,005,717 | A | * | 4/1991 | Oilar ..... 215/13.1 |
| 5,199,633 | A | | 4/1993 | Jantzen et al. |
| 5,409,124 | A | * | 4/1995 | Nasrallah et al. ..... 215/388 |
| 5,477,978 | A | * | 12/1995 | Lo ..... 220/710 |
| 5,484,405 | A | | 1/1996 | Edstrom, Sr. |
| 5,487,486 | A | * | 1/1996 | Meneo ..... 220/504 |
| 5,597,089 | A | * | 1/1997 | Smith ..... 220/710 |
| 5,850,949 | A | | 12/1998 | Koerbel et al. |
| 5,961,006 | A | * | 10/1999 | Dunham et al. ..... 222/383.1 |
| 6,126,632 | A | | 10/2000 | Verbovszky et al. |

(Continued)

*Primary Examiner*—Anthony D. Stashick
*Assistant Examiner*—Niki M. Eloshway
(74) *Attorney, Agent, or Firm*—Price, Heneveld, Cooper, DeWitt & Litton, LLP

(57) ABSTRACT

A drinking device having a fluid-containing portion is provided. The fluid-containing portion includes a first end having an opening and a second end substantially opposed thereto. The opening in the first end of the fluid-containing portion is typically larger than the opening in the second end of the fluid-containing portion. The device also includes a holding member having a generally C-shaped channel therein. The device includes a flexible tubular member including a first end and a second end. The first end of the tubular member is connected to the opening in a second end of the fluid-containing portion. The second end of the flexible tubular member is in releasable communication with the C-shaped channel of the holding member.

4 Claims, 4 Drawing Sheets

U.S. PATENT DOCUMENTS 6,321,977 B1 * 11/2001 Lee ..... 229/103.1
6,419,111 B1 7/2002 Kepner
6,439,419 B1 8/2002 Darabi
6,550,631 B2 * 4/2003 Thompson ..... 220/709

* cited by examiner

DRINKING DEVICE

CROSS-REFERENCE TO RELATED APPLICATION

This application is a continuation-in-part of U.S. patent application Ser. No. 10/866,891, filed Jun. 14, 2004, now a bandoned, the disclosure of which is hereby incorporated by reference in its entirety.

BACKGROUND OF THE INVENTION

The present invention is directed toward a drinking device, wherein a user may drink either from the rim or lip of the drinking device, from a tubular member which is substantially opposed to the rim or lip portion of the drinking device, or from an internal fluid-containing member.

Various drinking devices are known. Such drinking devices include devices outlined in U.S. Pat. No. 162,640 to Fowler. The '640 patent discloses an improvement in drinking-cups for invalids. Such a cup has a bottom section with an orifice positioned in substantially the center thereof and requires a spring activated release gate whereby a user must depress the spring activated release gate in order for a fluid to pass from the drinking-cup to drain out of the tube.

Another drinking device is disclosed in U.S. Pat. No. 4,650,100 to Echazabal, Jr. The '100 patent discloses a disposable dispensing container including, among other things, a dispensing spout that is removably retained with a storage channel integrally formed in recessed relation about the exterior peripheral surface of the container in a non-obstructing location (i.e., a dispensing spout releasably positioned within an integrally formed storage channel).

U.S. Pat. No. 5,199,633 to Jantzen et al. discloses a drinking aid including a cylindrical container, having an open top, a closed bottom, an annular wall, and an aperture formed through the wall and immediate adjacency to the closed bottom.

U.S. Pat. No. 5,850,949 to Koerbel et al. discloses a liquid container apparatus having a drain conduit secured to a handle. The container apparatus includes a container for a liquid and a hose or conduit connected to the bottom of the container through which fluid flows outwardly. The flexible conduit or discharge hose is connected to the bottom of the container and is disposed against a handle at the top of the container and connected to a breather spout when the container is being stored.

Surprisingly, Applicants have developed a novel drinking device having a fluid-containing portion including either a flexible tubular member attached to an opening on the bottom of the fluid-containing portion and/or an internal fluid-containing member. The bottom of the fluid-containing portion is optionally transparent and the device optionally has attached thereto a separate detachable bottom section. The detachable bottom section may include a pressure sensitive light arrangement, a game, an advertisement, an additional and separate fluid-containing portion, a paper dispenser and/or any written message.

SUMMARY OF THE INVENTION

One aspect of the present invention includes a drinking device having a fluid-containing portion. Such a fluid-containing portion has a first end including an opening and a second end substantially opposed thereto. The opening in the first end of the fluid-containing portion is typically larger than the opening in the second end. The device also includes a holding member having a generally C-shaped channel therein. The device includes a flexible tubular member including a first end and a second end. The first end of the tubular member is connected to the opening in the second end of the fluid-containing portion. The second end of the flexible tubular is in releasable communication with the C-shaped channel of the holding member.

Another aspect of the present invention includes a drinking device having a fluid-containing portion including a first open end and a second closed end, a holding member and a detachable bottom section. The detachable bottom section may include within it a pressure sensitive light arrangement, a game, an advertisement, a separate fluid-containing portion, a paper dispenser and/or any written message.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
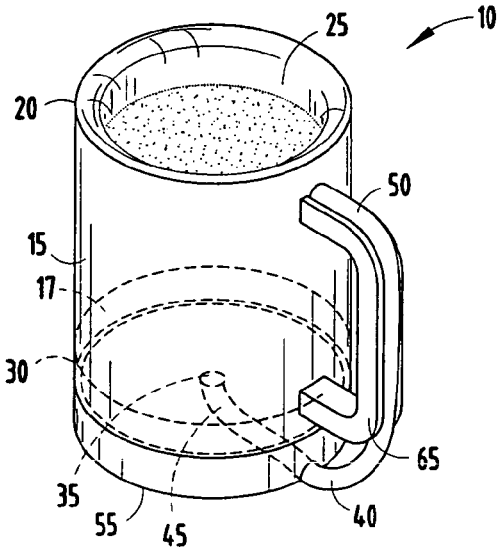
FIG. 1 is a plan view of the drinking device according to one aspect of the present invention.
Figure 2:
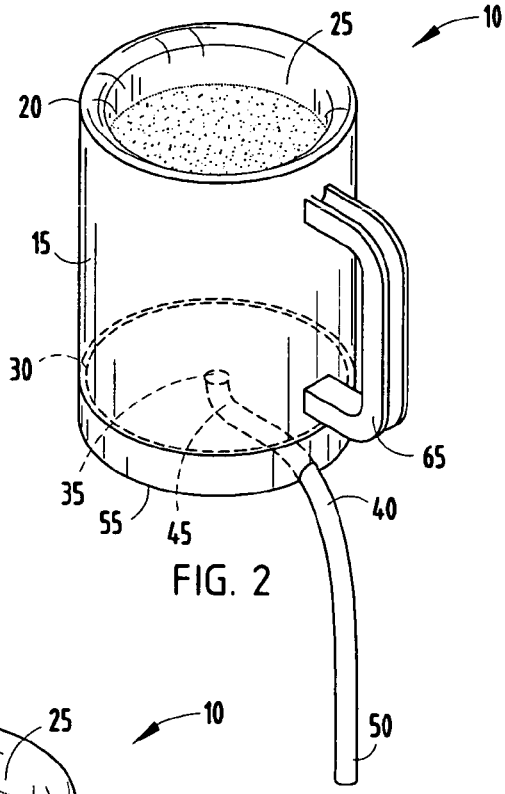
FIG. 2 is a plan view of the drinking device having the second end of the flexible tubular member detached from the handle member according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The first embodiment of the present invention includes the drinking device having a fluid-containing portion including a first end having an opening therein and a second end having an opening therein, a handle member comprising a generally C-shaped channel, a flexible tubular member connected at one end to the opening in the second end of the fluid-containing portion and releasably attached at a second end to the generally C-shaped channel in the handle member.

Referring to FIG. 1, reference numeral 10 designates one embodiment of the drinking device of the present invention. Device 10 includes a fluid-containing portion 15. Fluid-containing portion 15 may be any shape, including, but not limited to, cylindrically-shaped, rectangularly-shaped, and may be shaped to resemble an object such as a sporting good helmet, a sporting good device, a sporting good hat, or the like. It may further be shaped like a stein, etc., or any combinations or derivations of any of these shapes listed above. However, cylindrically-shaped is preferred. Fluid-containing portion 15 may also be constructed of any materials, including, but not limited to, plastic, wood, metal, foam, glass, etc. or any combinations or derivations of any of these. However, plastic is preferred. Fluid-containing portion 15 includes a first end 20 including an opening 25 therein and a second end 30. Second end 30 is substantially opposed to first end 20. Second end 30 also contains an opening 35 therein. The opening 25 in first end 20 is typically larger than opening 35 in second end 30. The opening 35 in second end 30 of fluid-containing portion 15 may be located anywhere within second end 30, however, preferably opening 35 is located at the bottom-most part of second end 30.

As seen in FIG. 1, a handle member 65 is attached to the fluid-containing portion 15 of device 1. Typically, handle member 65 includes an outward facing (i.e., facing away from the fluid-containing portion 15) C-shaped channel. However, this channel may be positioned on either and/or all sides of channel member 65 and may be an enclosed channel. However, an outward facing C-shaped channel is preferred. Alternatively, handle member 65 may be shaped to otherwise releasably attach to flexible tubular member 40. In other words, any type of releasable attachment will suffice. Handle member 65 may be constructed of any materials, including, but not limited to, plastic, metal, wood, foam, glass, etc. However, plastic is preferred. Handle member 65 may be any shape and may be any size, however, a typically full-grip handle is preferred (see FIG. 1) and an overall size of from about 2 inches to about 24 inches is typical, a range of from about 4 inches to about 20 inches is more typical, and a range of from about 5 inches to about 15 inches is most typical.

Device 1 may optionally include a separate second fluid-containing portion 17 disposed between fluid-containing portion 15 and second end 30 of fluid-containing portion. The second fluid-containing portion could be limited to holding approximately 6–10 ounces of fluid, more preferably 4–6 ounces of fluid and most preferably 2–4 ounces of fluid. This second fluid containing portion includes a gate whereby a user can open the gate allowing a limited amount of fluid to pass from fluid-containing portion 15 into this second fluid-containing portion. Typically, the amount of fluid allowed to enter the second fluid-containing portion is limited by the size of the second fluid-containing portion. The bottom portion of the second fluid-containing portion is formed by second end 30 of fluid-containing portion 15 of device 1. Therefore, if a user chose to drink from tubular member 40 attached to the bottom of second fluid-containing portion, the user would only be able to drink the fluid contained within second fluid-containing portion and not the entire contents of fluid-containing portion 15.

A flexible tubular member 40 is attached at a first end 45 to opening 35 in the second end 30 of fluid-containing portion 15. This connection may be any type of connection, including, but not limited to, an adhered-connection, a soldered-connection, a welded-connection or a tension-type connection, etc. or any combinations or derivations of any of the above. However, an adhered-connection is preferred. Tubular member 40 may be constructed of any type of flexible material, including, but not limited to, rubber, plastic, foam, etc. or any combinations or derivations thereof. Preferably, a rubber flexible material is used for tubular member 40. Flexible tubular member 40 may be any length, including, but not limited to, a typical length of from about 3 inches to about 18 inches, more typically from about 5 inches to about 15 inches, and most preferably from about 6 inches to about 12 inches. Flexible tubular member 40 includes a second end 50 that is releasably attached to a C-shaped channel, or alternatively, an enclosed channel on handle member 65. Tubular member 40 may optionally include a gate at first end 45 on either tubular member 40 or within, at, or around the connection between opening 35 and first end 45 of tubular member 40. Tubular member 40 may also include a gate at second end 50. Alternatively, handle member 65 may include a gate in, or around, the area where second end 50 attaches to handle member 65. In use, the gate may be opened thereby allowing fluid to flow into tubular member 40. The gate is then closed so that a user may only drink the amount of fluid contained within tubular member 40.

In use, a user may either drink from the opening 25 in the first end 20 of fluid-containing portion 15, alternatively, the user may release the second end 50 of tubular member 40 from the C-shaped channel and handle member 65 and drink from this second end.

Figure 6:
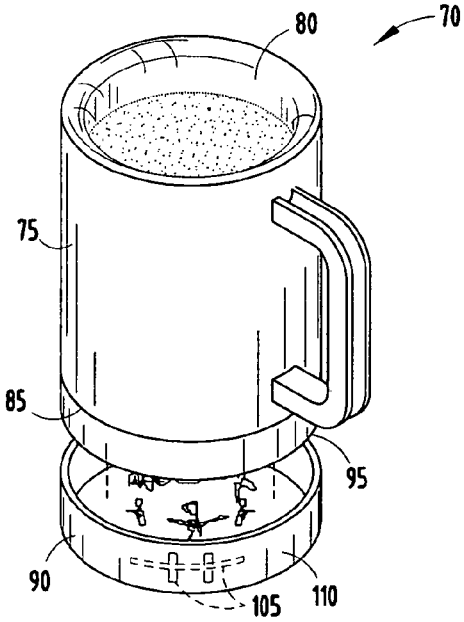
FIG. 6 is an exploded plan view of the drinking device and the detachable bottom section according to one aspect of the present invention.

A second embodiment of the present invention includes a drinking device 70 having a fluid-containing portion 75 including a first open end 80 and a second closed end 85 (see FIG. 6). The first open end 80 includes an opening at least large enough to pour a liquid from device 70, through open end 80, or to pour a liquid through open end 80 into fluid-containing portion 75 of device 70. As in the previous embodiment, this embodiment also includes a handle member. The discussion above handle member 65 is also incorporated and applied hereto. Further, the materials, shapes, and sizes for the various components as discussed above applies also to this embodiment and are all incorporated herein and applied hereto.

Device 70 of this embodiment also includes a detachable bottom section 90. Detachable bottom section 90 may be connected to the bottom 95 of device 70 by any releasably attached connection, including, but not limited to, a conventional threaded/screw-type attachment, a tension fit, clips, snaps, a tongue and groove snap or clip fit arrangement, by an adhesive, Velcro, etc., or any combinations or derivations of any of the above. However, a clip fit or tension fit is generally preferred.

Detachable bottom section 90 typically includes a device or material within section 90. Such a device or material may include, but is not limited to, a pressure sensitive light arrangement, a game, an advertisement, a separate fluid-containing portion, a paper dispenser or any written message. Alternatively, section 85 may include a slot and/or a compartment having an opening 105 in communication with the exterior 110 of detachable bottom section 90 in which various printed materials (slogans, sayings, advertisements, etc.) may be easily inserted and/or removed as desired. It is preferred that these writings, etc. are placed in section 90 so they face the second closed end 85 of fluid-containing portion 75. Detachable bottom section 90 may be transparent. Alternatively, detachable bottom section 90 may include slot(s) 105 (see FIG. 6). When slot(s) 105 are vertically positioned, relative to the bottom of the device when the device is sitting on a flat horizontal surface, slot(s) 105 are one or more open ends of an open channel that extends around the perimeter of detachable bottom section 90. Advertisements and/or any messages may be placed with this channel. Typically, such messages would be positioned, so any wording or a message face out and away from the device. At least this section (i.e., the outward facing section) of detachable bottom section 90 is made of a transparent material. Slot(s) 105 may also be horizontal, relative to the bottom of the device when the device is sitting on a flat horizontal surface. In this case, detachable bottom section 90 includes an opening within the detachable bottom section, for receiving generally printed material.

Figure 5:
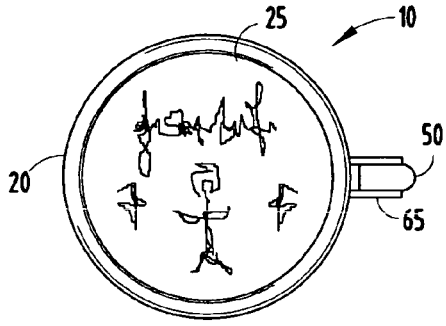
FIG. 5 is a top perspective view as viewed through the first end of the fluid-containing portion according to one aspect of the present invention.

In this embodiment, the second closed end 85 of device 70 may be made of any material and be any color, however, the second closed end 85 is preferably transparent. Therefore, when a user looking through first end 80 of fluid-containing portion 75 of device 70, the writing, etc. and detachable bottom section 90 will be visible through second closed end 85 of fluid-containing portion 75 (see FIG. 5).

Figure 3:
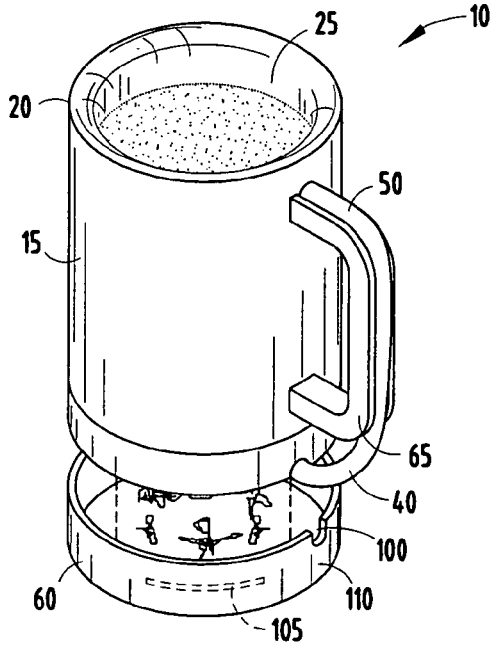
FIG. 3 is an exploded plan view of the drinking device and the detachable bottom section according to one aspect of the present invention.
Figure 4:
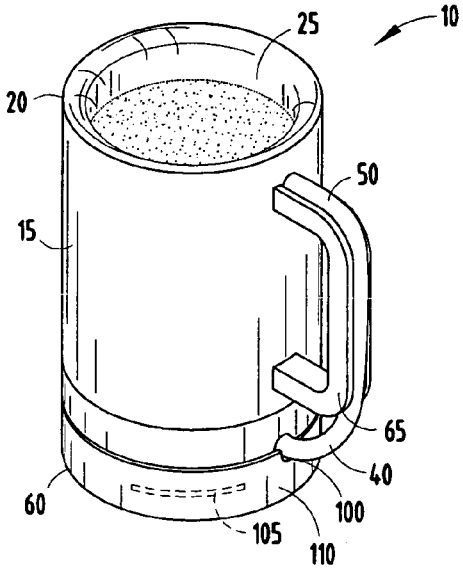
FIG. 4 is a plan view of the drinking device and the detachable bottom section according to one aspect of the present invention.

A third embodiment of the present invention includes the device of the first embodiment, further including the detachable bottom section 90 of the second embodiment (see FIG. 3). Detachable bottom section 90 typically includes a cutout 100 to accommodate tubular member 40.

Flexible tubular member 40 of any of the embodiments disclosed herein may include one or more fluid-containing gates.

Figure 7:
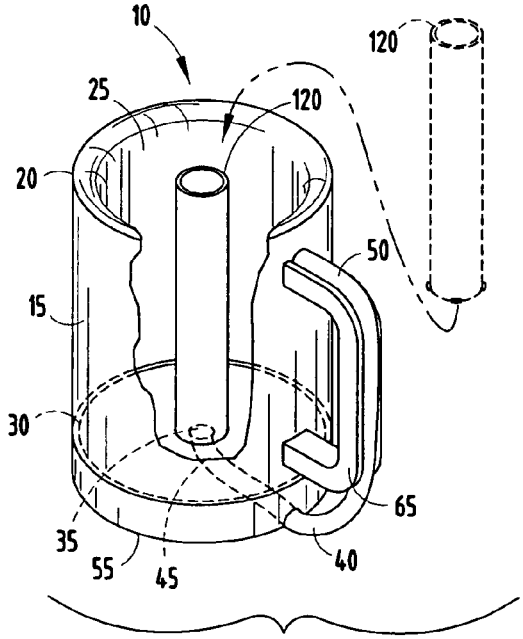
FIG. 7 is a partial plan view of the drinking device having a bottom mounted internal fluid-containing member according to one aspect of the present invention.

Referring to FIG. 7, a fourth embodiment of the present invention includes a separate fluid-containing portion 120 may optionally be removably attached to second end 30 generally about opening 35, or the immediate area surrounding opening 35 (i.e., within a 3 inch radius as measured from the center of opening 55). Portion 120 generally includes an inner fluid-containing area and portion 120 may be any shape, including, but not limited to, cylindrically-shaped, rectangularly-shaped, etc. However, cylindrically-shaped is preferred. The connection between portion 120 and second end 30, or there abouts may be any type of connection, including, but not limited to a snap connection, a threaded screw-type connection, a tension fit, an adhered connection, etc. However, a snap-type connection is preferred. This may be a fluid tight connection such that when portion 120 contains fluid, this fluid cannot leak into the fluid-containing portion 120 of device 10.

In use, portion 120 may contain the same type of fluid as fluid-containing portion 15, or may contain a different type of fluid. A user may drink fluid from portion 15 from a first end 20. In doing so, the contents, if any, of portion 120 will not spill out due to an optional removable cap on the exposed end of portion 15. The generally open end of portion 120 may also include a cap or covering to prevent spills. A user may also drink the contents of portion 120 via tubular member 40 as is generally described above.

Figure 8:
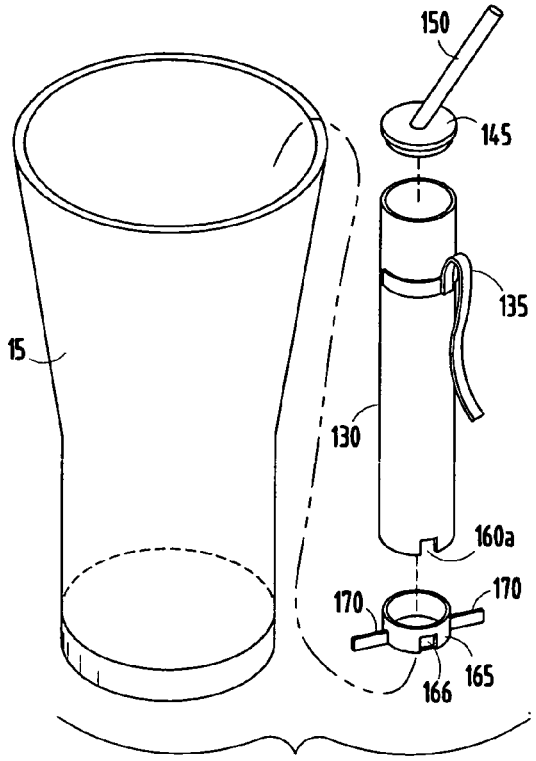
FIG. 8 is a plan view of the drinking device having a detachable internal fluid-containing member according to one aspect of the present invention.

Referring to FIG. 8, this embodiment of the present invention generally includes a detachable internal fluid-containing member 130. Detachable internal fluid-containing member 130 includes an optional retaining member 135, which retains fluid-containing member 130 to the lip or rim of the drinking device. Detachable internal fluid-containing member 130 optionally contains a lid 145, which may or may not contain tubular member 150. Lid 145 is used to generally contain the contents within internal fluid-containing member 130, while tubular member 150 may be used to drink the contents, or, alternatively, to force the contents out of internal fluid-containing member 130 by blowing through tubular member 150, provided there is an optional gate 160*a* in the member 130. Gate 160*a* may be small enough so that the fluid within member 130 cannot escape without having pressure applied to the fluid to force it out of 130 (i.e., blowing air in tubular member 150 will force the fluid out). Gate cap 165 includes gate opening 166, which when aligned with gate 160(*a*) allows the contents of detachable fluid-containing member 130 to come in contact with the fluid in fluid-containing portion 15 of device 10. Paddles 170 and detachable fluid-containing member 130 may then be used to blend or mix the two fluids together.

Figure 9:
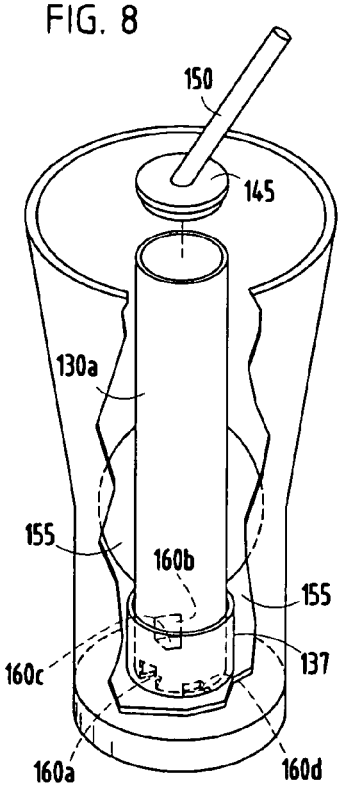
FIG. 9 is a partial plan view of the drinking device having a bottom mounted internal fluid-containing member capable of rotating about a perpendicular axis, relative to the surface the device is sitting upon according to one aspect of the present invention.

Referring to FIG. 9, a user may blow air into tubular member 150, which will force the fluid contents of detachable fluid-containing member 130 out and through optional gate 160*a*. As described above, detachable fluid-containing member 130 is detachably connected to the second end of the fluid-containing member 15. This connection may include, but is not limited to a tension fit, a swivel fit, etc., so long as detachable fluid-containing member 130 may spin or move about a perpendicular axis relative to the surface upon which device 10 is sitting. Once the fluid from detachable fluid-containing member 130 has been released via the opening created between gates 160*a* and gates 160*b* and 160*c*, a user may rotate the detachable fluid-containing member 130 in a clockwise or counter clockwise direction about the aforementioned perpendicular axis. When rotating the optional paddles 155 in blending or mixing the fluid from the detachable fluid-containing member 130 with the fluid from fluid-containing portion 15.

Figure 10:
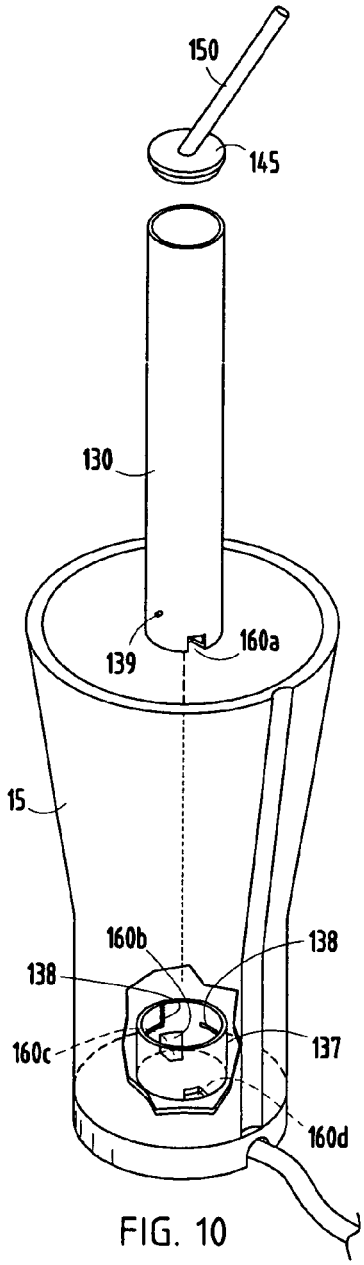
FIGS. 10,11 and 11A are partial plan views of the drinking device having a bottom mounted internal fluid-containing member capable of rotating about a perpendicular axis, relative to the surface the device is sitting upon, wherein the fluid-containing member includes at least one cutout and the collar.

Referring to FIG. 10, alternatively, gate 160*a* may be substantially aligned gate 160*a* to allow the fluid from within detachable fluid-containing member 130 to drain out into tubular member.

Figure 11A:
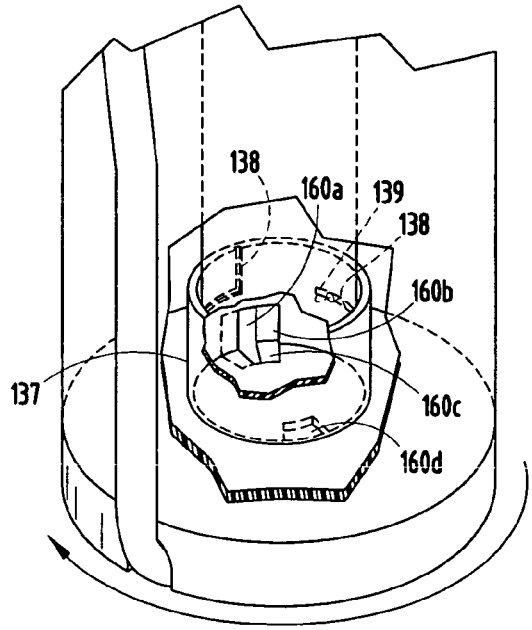
Figure 11:
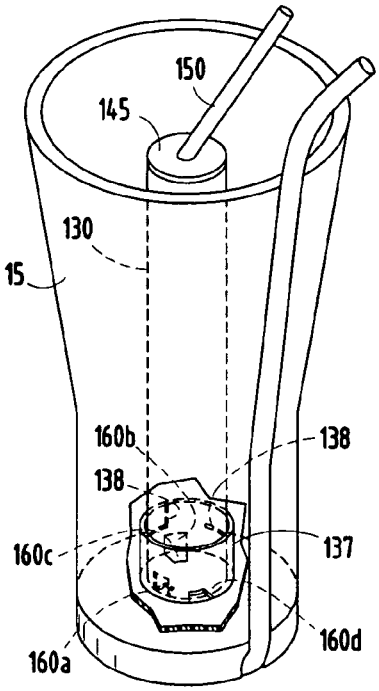

Referring to FIGS. 10 and 11, detachable fluid-containing member 130 includes snap button 139. Snap button 139 snaps into snap ring 138 on receiving collar 137 to create a snap fit. Receiving collar 137 is permanently attached to second end 30 of fluid-containing portion 15 of device 10. This snap fit is a fit tight enough to not allow fluid to pass between receiving collar 137 and detachable fluid-containing member 130, however, this fit allows a user to move detachable fluid-containing member 130 about a perpendicular axis relative to the surface which device 10 is resting upon.

Referring to FIGS. 10 and 11, when the gates 160(*a*) and gates 160(*b*) and 160(*c*) are substantially aligned and the contents of detachable fluid-containing member 130 are forced out of member 130, the contents pass through gates 160(*a*) and gates 160(*b*) and 160(*c*) and enter tubular member 40 of device 10. Upon aligning gate 160(*a*) with gate 160(*d*), the contents from detachable fluid-containing member 130 drain out through flexible tubular member 40.

Figure 12:
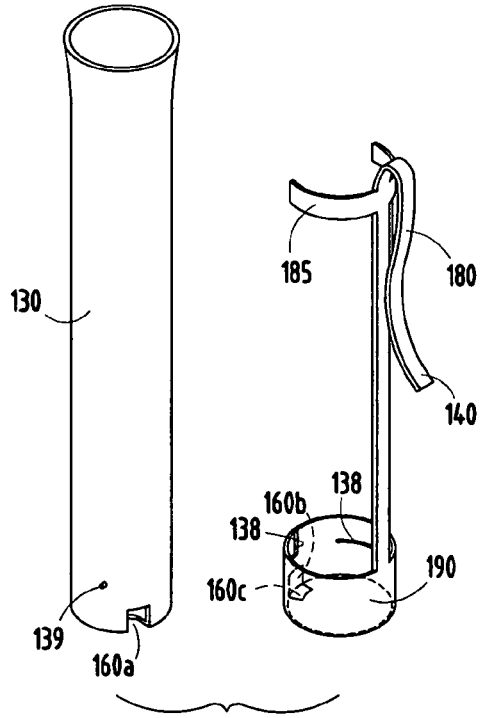
FIG. 12 is an exploded plan view of the detachable fluid-containing member and support according to one aspect of the present invention.

Referring to FIG. 12, support 180 may be used to retain detachable member 130 to the lip or rim of drinking device. Support 180 includes a generally C-shaped portion 185 fitting around detachable member 130 and lip member 140. Support 180 includes a bottom support member 190, which holds or supports detachable member 130. Bottom support member 190 includes gates 160(*b*) and 160(*c*). When gate 160(*a*) and gates 160(*b*) and 160(*c*) are substantially aligned, the fluid from within detachable member 130 contacts the fluid within fluid-containing member 15.

In the foregoing description, it will be readily appreciated by those skilled in the art that modifications may be made to the invention without departing from the concepts disclosed herein. Such modifications are to be considered as included in the following claims, unless these claims by their language expressly state otherwise.

This invention claimed is:

1. A drinking device, comprising:

a fluid-containing portion comprising a first end having an opening therein and a second end having an opening therein and a bottom-most section, wherein the second end substantially opposed to the first end and the opening in the first end is larger than the opening In the second end the fluid containing portion defining an inner fluid cavity;

a holding member comprising generally C-shaped channel having a central portion spaced apart from an outer surface of the fluid-containing portion to define a gap having sufficient size to permit insertion of at least one finger of a user between the central portion of the C-shaped channel and an outer surface of the fluid-containing portion; and a flexible tubular member comprising a first end and a second end, wherein the first end is connected to the opening in the second end of the fluid-containing portion and the second end of the tubular member is in releasable communication with at least the central portion of the C-shaped channel of the holding member;

an upwardly extending tubular portion disposed within the inner fluid cavity and defining a secondary fluid-containing cavity having an open upper end;

the tubular portion includes an opening in a lower end in fluid communication with the opening in the second end of the fluid-containing portion; and wherein the second end of the fluid-containing portion defines an upper surface that is exposed to the inner fluid cavity, and including:

an upwardly extending support structure having a support cavity, and wherein the lower end of the tubular portion is disposed in the support cavity.

2. The drinking device of claim 1, wherein:

the support structure defines a first passageway from the support cavity to the secondary fluid-containing cavity, and a second passageway forming the opening in the second end of the fluid-containing portion, and wherein the opening in the lower end of the tubular portion can be selectively positioned in fluid Communication with the first passageway and the second passageway.

3. A device for drinking, comprising:

a body portion defining a first cavity for fluid and having an upper end that is open to the cavity and a lower end portion having an opening therethrough;

an upwardly extending tubular inner member having open upper end and a lower end connected to the lower end portion of the body portion to retain the tubular member in a generally upright position within the cavity, the tubular inner member defining a second cavity and a first fluid passageway at the lower end in fluid communication with the opening in the lower end portion; and an external tubular member having an opening at a first end fluidly connected to the opening in the lower end portion of the body portion; and wherein the lower end portion of the body portion defines an upwardly facing surface and a support structure extending upwardly into the first cavity and supporting the tubular inner member in an upright position.

4. The device of claim 3, wherein:

the support structure defines a second passageway in fluid communication with the first cavity; and wherein:

the tubular inner member can be moved to selectively position the first fluid passageway in fluid communication with the second passageway.

* * * * *